US010472133B2

(12) United States Patent
Tamarindo

(10) Patent No.: US 10,472,133 B2
(45) Date of Patent: Nov. 12, 2019

(54) CAPS FOR CONTAINERS

(71) Applicant: GUALA PACK S.p.A., Castellazzo Bormida (AL) (IT)

(72) Inventor: Stefano Tamarindo, Castellazzo Bormida (IT)

(73) Assignee: GUALA PACK S.p.A., Castellazzo Bormida, AL (IT)

( * ) Notice: Subject to any disclaimer, the term of this patent is extended or adjusted under 35 U.S.C. 154(b) by 0 days.

(21) Appl. No.: 14/409,480

(22) PCT Filed: Jun. 21, 2013

(86) PCT No.: PCT/IB2013/055109

§ 371 (c)(1),
(2) Date: Dec. 19, 2014

(87) PCT Pub. No.: WO2014/013361

PCT Pub. Date: Jan. 23, 2014

(65) Prior Publication Data

US 2015/0144632 A1 May 28, 2015

(30) Foreign Application Priority Data

Jul. 18, 2012 (IT) ..... BS2012A0110

(51) Int. Cl.
*B65D 41/34* (2006.01)
*B65D 75/58* (2006.01)
(Continued)

(52) U.S. Cl.
CPC ..... *B65D 41/3404* (2013.01); *B65D 41/0485* (2013.01); *B65D 51/24* (2013.01); *B65D 75/5883* (2013.01); *B65D 2101/0069* (2013.01)

(58) Field of Classification Search
CPC ..... B65D 41/3404; B65D 41/0485; B65D 2101/0069
See application file for complete search history.

(56) References Cited

U.S. PATENT DOCUMENTS 1,012,390 A * 12/1911 Marles ..... 215/302
1,684,415 A * 9/1928 Flavius ..... 215/330
(Continued)

FOREIGN PATENT DOCUMENTS

CN 100519355 C 7/2009
EP 0958185 B1 10/2003
(Continued)

OTHER PUBLICATIONS

Paul Van Den Hoonaard, Caps, OHIM—Office for Harmonization in the Internal Market (now EUIPIO), Design Registration No. 002003632-0001, Mar. 14, 2012.
(Continued)

*Primary Examiner* — Chun Hoi Cheung
*Assistant Examiner* — Brijesh V. Patel
(74) *Attorney, Agent, or Firm* — Thomas|Horstemeyer, LLP

(57) ABSTRACT

Caps for containers or for spouts in particular for containing liquids, such as fruit juice and other similar drinks, are provided having highly visible guarantee seals. Such caps include an annular wall having a lower free rim which has a waved pattern. These features allow consumers to recognize immediately if the guarantee seal has been broken.

8 Claims, 3 Drawing Sheets

(51) Int. Cl.
*B65D 41/04* (2006.01)
*B65D 51/24* (2006.01)

(56) References Cited

U.S. PATENT DOCUMENTS

| | | | | | |
|---|---|---|---|---|---|
| 2,124,874 | A * | 7/1938 | Conner et al. | | 215/251 |
| 2,162,752 | A * | 6/1939 | Schauer | | 215/252 |
| 2,162,754 | A * | 6/1939 | Schauer | | 215/252 |
| 2,169,686 | A * | 8/1939 | Fabrice | | 215/254 |
| 2,172,159 | A * | 9/1939 | Conner et al. | | 215/252 |
| 3,199,702 | A * | 8/1965 | Fischbach | | 215/252 |
| 3,737,064 | A | 6/1973 | Patel et al. | | |
| 3,982,651 | A * | 9/1976 | Braun | B65D 41/17 | 220/260 |
| 4,573,601 | A * | 3/1986 | Berglund | B65D 41/3452 | 215/252 |
| 5,033,632 | A * | 7/1991 | Mattia | B65D 41/3452 | 215/252 |
| 5,203,637 | A * | 4/1993 | Nishimura et al. | | 401/202 |
| 5,662,231 | A * | 9/1997 | Adams et al. | | 215/254 |
| D415,684 | S * | 10/1999 | Reidenbach | | D9/453 |
| 5,964,363 | A | 10/1999 | Kelly et al. | | |
| 5,971,182 | A * | 10/1999 | Berge et al. | | 215/252 |
| D679,597 | S * | 4/2013 | Tamarindo | | D9/452 |
| 8,443,999 | B1 * | 5/2013 | Reinders | | 220/303 |
| D717,650 | S * | 11/2014 | Tamarindo | | D9/454 |
| D719,830 | S * | 12/2014 | Uchida | | D9/503 |
| 2002/0185464 | A1 * | 12/2002 | Luker | | 215/334 |
| 2004/0200797 | A1 * | 10/2004 | Hicks et al. | | 215/305 |
| 2005/0006334 | A1 * | 1/2005 | Luker | | 215/334 |
| 2006/0000792 | A1 * | 1/2006 | Hennebelle | | 215/228 |
| 2008/0302753 | A1 * | 12/2008 | Jochem et al. | | 215/228 |
| 2009/0223963 | A1 | 9/2009 | Bisio | | |
| 2012/0211460 | A1 * | 8/2012 | Tamarindo | | 215/228 |
| 2013/0175274 | A1 * | 7/2013 | Kim | | 220/288 |

FOREIGN PATENT DOCUMENTS

| | | | |
|---|---|---|---|
| EP | 1 676 783 | A1 | 7/2006 |
| FR | 2578513 | A1 | 9/1986 |
| JP | 46-15830 | Y1 | 6/1971 |
| JP | 53-45157 | U | 4/1978 |
| JP | 2004-231229 | A | 8/2004 |
| JP | 2010-507540 | A | 3/2010 |
| KR | 2002-0097123 | A | 12/2002 |
| WO | 2004/108545 | A1 | 12/2004 |
| WO | 2008/050361 | A1 | 5/2008 |
| WO | 2008050361 | A1 | 5/2008 |
| WO | 2014/007612 | A1 | 1/2014 |
| WO | 2014007612 | A1 | 1/2014 |

OTHER PUBLICATIONS

EUIPO Certificate of Registration No. 002003632-0001 dated Mar. 6, 2012.

Examination Report issued by the Patent Office of India for Indian Application No. 10687/DELNP/2014, dated Mar. 28, 2019 (6 pages).

* cited by examiner

CAPS FOR CONTAINERS

CROSS-REFERENCE TO RELATED APPLICATIONS

This application is a National Phase Application of PCT International Application No. PCT/IB2013/055109, International Filing Date, Jun. 21, 2013 claiming priority to Italian Patent Application No. BS2012A000110, filed Jul. 18, 2012, each of which is hereby incorporated by reference in its entirety.

FIELD OF THE INVENTION

The present invention relates to a plastic cap for containers, in particular a cap for containers of liquid foods, for example for children, provided with a guarantee seal.

BACKGROUND OF THE INVENTION

As is known, most caps for containers, especially if destined to contain liquid foods, are provided with a guarantee seal, having weakened portions which as result of unscrewing of the container cap, break, emphasizing the fact that the container has already been opened.

However, sometimes the user does not take much notice of the effective condition of the guarantee seal. For the user to realize that the guarantee seal is broken, it is often necessary to upturn the container or bottle and carefully inspect the appearance of the seal. This means that the conditions of the guarantee seal are not immediately visible to the user, who only sporadically or randomly performs such control.

SUMMARY OF THE INVENTION

The purpose of the present invention is to overcome the drawbacks mentioned with reference to the prior art.

Such purpose is achieved by caps as described and claimed herein.

Features and advantages of caps according to the present invention will be evident from the following description, with reference to the Figures briefly described below.

DETAILED DESCRIPTION

Figure 1:
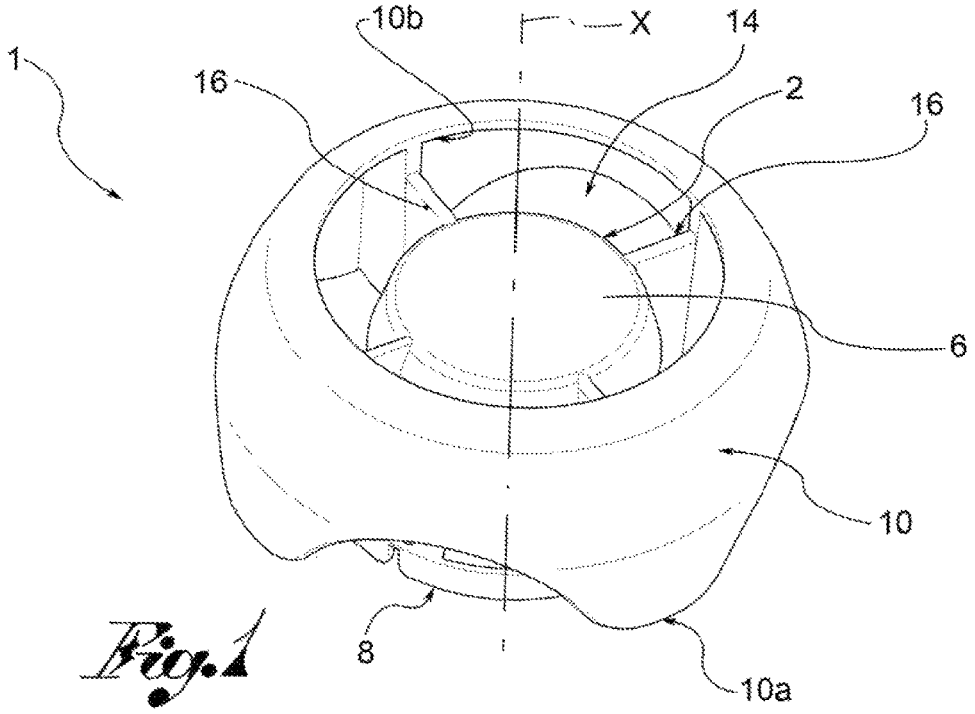
FIG. 1 shows a cap according to the present invention, from an observation point high up.
Figure 2:
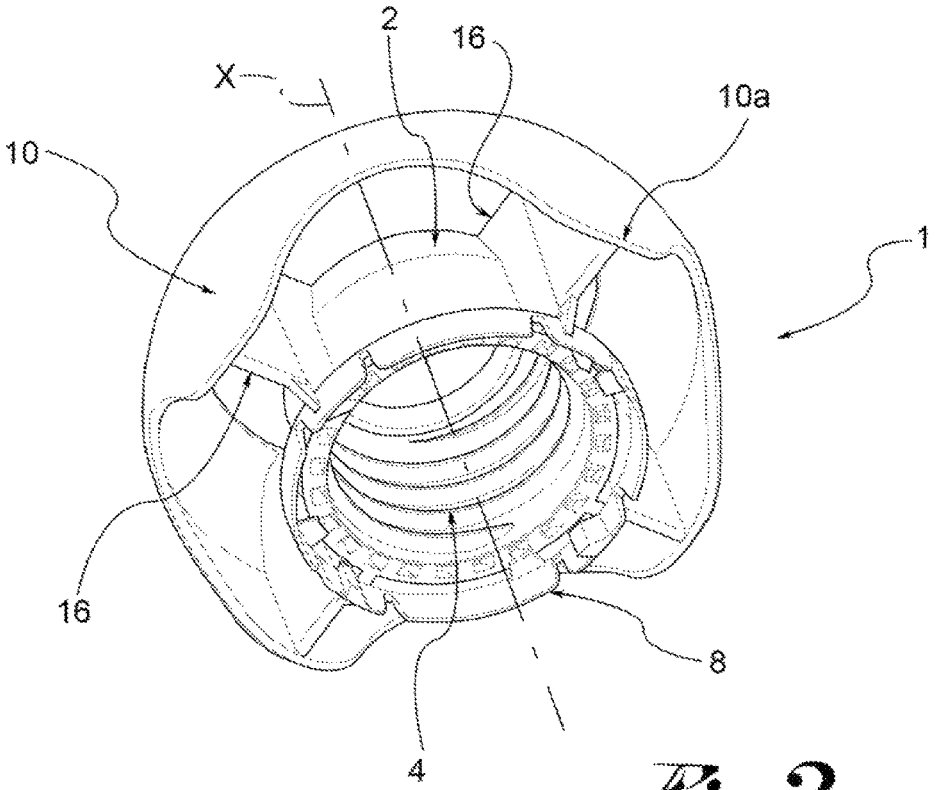
FIG. 2 shows the cap in FIG. 1, from an observation point low down.
Figure 4:
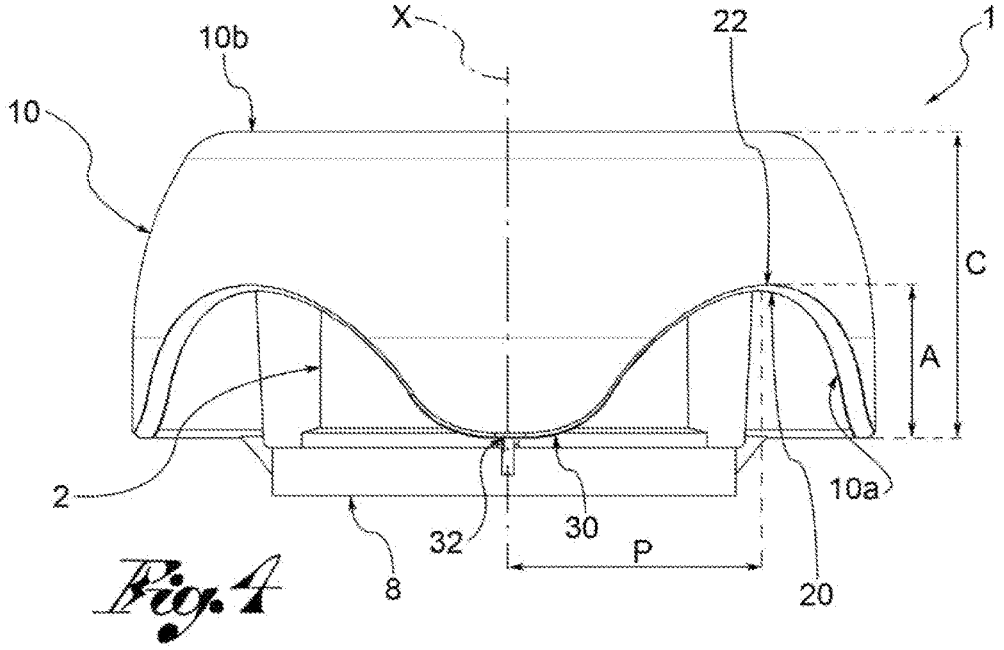
FIG. 4 shows the cap in FIG. 1, in a side view.
Figure 3:
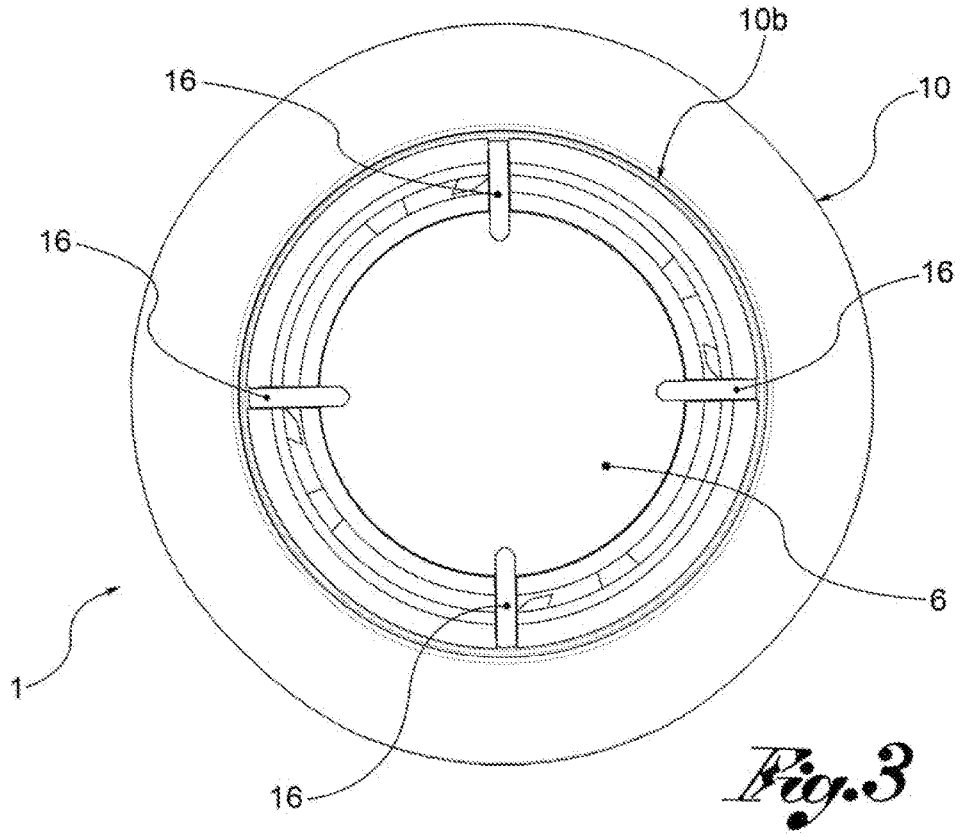
FIG. 3 shows the cap in FIG. 1, in a plan view from above.
Figure 5:
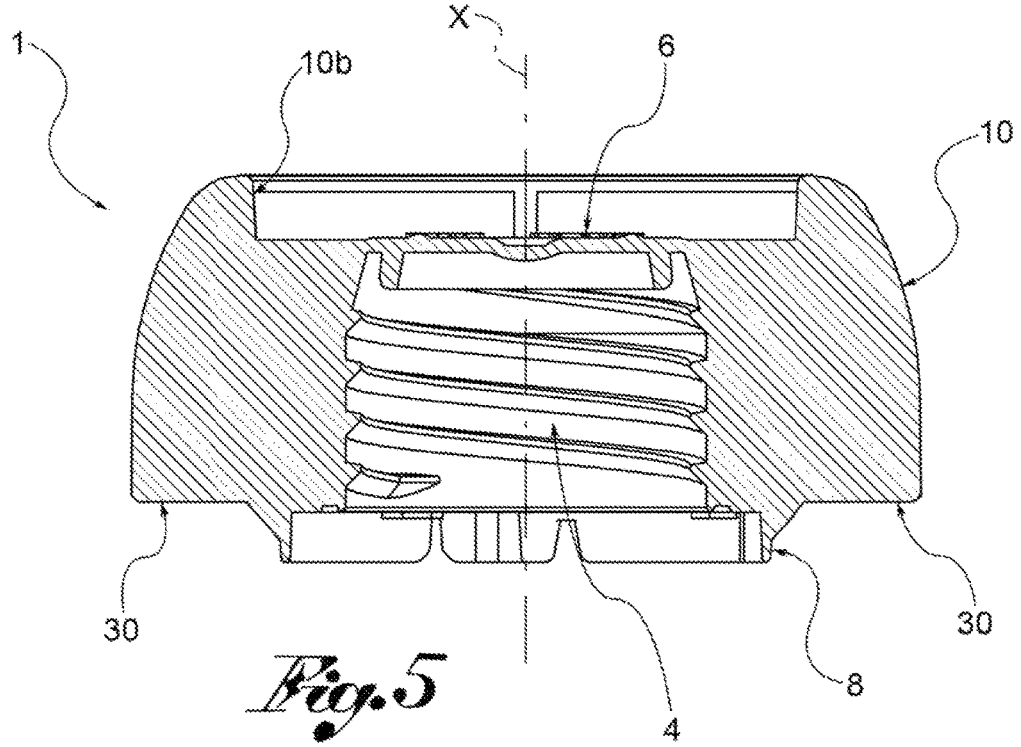
FIGS. 5 and 6 show views in longitudinal cross-section of the cap in FIG. 1.
Figure 6:
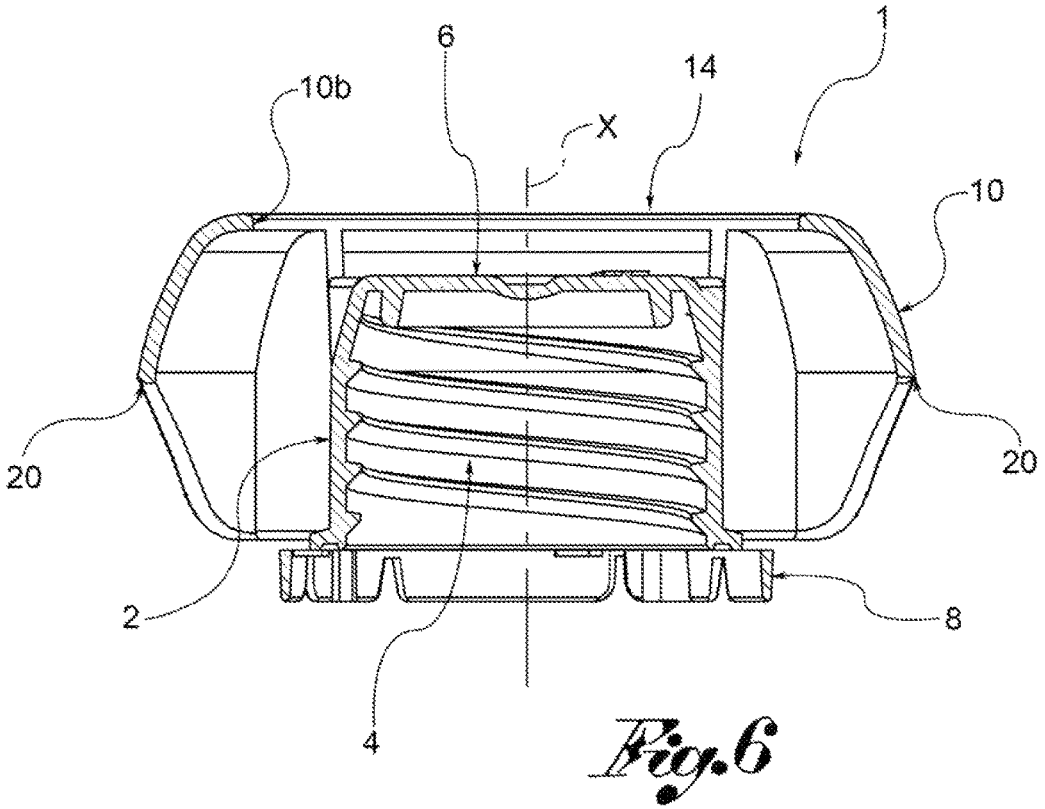

With reference to the appended drawings, reference numeral 1 globally denotes a cap, preferably made of plastic, for containers of liquids, especially for children, such as fruit juices and other drinks.

The cap 1 comprises a central tubular body 2, which extends along a central axis X.

The central body 2, is preferably a cylindrical shape on the outside and is provided with a thread 4 on the inside for screwing to the neck of the container or to a spout of a flexible pouch.

The central body is closed on the top by a base 6.

In addition, the cap 1 comprises a guarantee seal 8 suitable for breaking when the cap is unscrewed from the container, for example positioned at the lower end of the central body 2, on the side opposite the base 6.

The construction and functional details of the guarantee seal 8 are described, for example, in the International Application WO 2008/050361 in the Applicant's name.

The cap 1 further comprises an annular wall 10 which extends around said central axis X, externally to the central body 2, surrounding it annularly, for example continuously.

Preferably the annular wall 10 is the grip of the cap, that is to say the part destined for gripping by the user to screw/unscrew the cap from/to the container.

According to a preferred embodiment, the annular wall 10 has a cap-shape tapered from the bottom (at the point of the guarantee seal) towards the top (at the base 6 of the central body 2).

The annular wall 10 has a lower free rim 10*a* and an upper free rim 10*b*, at the base 6 of the central body 2.

For example, the upper rim 10*b* is a free rim and defines an aperture 14, preferably of a circular shape, for example such as to radially close the base 6 and the central body 2.

The central body 2 is joined to the annular wall 10.

For example, the cap 1 comprises a plurality of tabs 16 projecting radially outwards from the central body 2, which join said central body to the annular wall 10.

Preferably, the tabs 16 are four in number, angularly equidistant.

The annular wall 10 is radially distanced from the central body, so that, thanks to the angularly spaced tabs, a passage open to the passage of the air is created to prevent suffocation accidents due for example to the accidental swallowing of the cap by a child.

According to the invention, the lower free rim 10*a* has a waved pattern, that is to say formed of a sequence of valleys 20 and peaks 30.

For said valleys 20 a bottom 22 is defined as the point of maximum vicinity to the upper rim 10*b* and for said peaks 30 a top 32 is defined as the point of maximum distance from the upper rim 10*b*.

Preferably the valleys 20 and the peaks 30 are in regular succession, for example alternating. In the embodiment shown, four peaks 30 are provided alternated with four valleys 20.

Preferably the lower free rim 10*a* has a regular pattern free of sharp corners; in particular, the bottom 22 of the valleys 20 is rounded and the top 32 of the peaks 30 is rounded.

Having defined the height C of the crest 30 as the distance along the central axis X separating the top 32 of the peak 30 from the upper rim 10*b*, and the height A of the valley 20 as the distance along the central axis X between the top 32 of the peak 30 and the bottom 22 of the valley 20, the characteristic ratio R=C/A is defined.

Preferably the characteristic ratio R is from 1.5 to 2.5 and preferably equal to 2.

The pitch P being defined as the circumferential distance between the top 32 of a first peak 30 and the bottom 22 of a subsequent valley 20 adjacent to the first peak 30 and L being defined as the length of the circumference subtended by the lower rim, a further characteristic ratio Q=L/P is defined.

Preferably the further characteristic ratio Q is between 6 (three valleys and three peaks) and 12 (six valleys and six peaks) and is preferably 8 (four valley and four peaks).

Preferably in addition, the guarantee seal 8 is radially contained in the lower free rim 10*a*, that is, said lower free rim 10*a*, even if positioned at different heights from the guarantee seal, annularly surrounds said guarantee seal.

Preferably in addition, the cap is made in one piece in plastic material, for example by moulding.

Innovatively, the cap according to the present invention overcomes the drawback of scarce visibility of the guarantee seal as mentioned with reference to the prior art.

In fact, the presence of the valleys keeps the guarantee seal in view, even if the container or bottle is not overturned.

In addition, at the same time, the presence of the peaks makes it possible to avail of an ample gripping surface for the annular wall, when this acts as a grip of the cap, to be gripped in order to unscrew it from the container.

It is clear that a person skilled in the art may make modifications to the cap described above so as to satisfy contingent requirements.

For example, according to one embodiment variation (not shown), the lower free rim has a pattern defined by a series of sections forming sharp corners with each other, such as a series of broken sections.

According to yet a further embodiment, the annular wall has a spherical cap shape.

Such variations are also included within the scope of protection as claimed herein.

The invention claimed is:

1. A cap for a container or spout comprising a central tubular body, which extends along a central axis and is closed by a base and has a lower end on a side of the central tubular body opposite the base, a guarantee seal suitable for breaking when the cap is unscrewed from the container, said guarantee seal being positioned breakably connected to the lower end of the central tubular body on the side opposite the base, an annular wall positioned externally to said central tubular body and having a lower free rim, and an upper free rim at the base of the central tubular body, wherein said lower free rim comprises a waved pattern that annularly surrounds said guarantee seal on the side opposite the base, wherein the lower free rim is formed of a sequence of valleys and peaks, said valleys having a bottom being defined as a point of closest vicinity to the upper free rim and said peaks having a top being defined as a point of maximum distance from the upper free rim, and the top of the peak of at least one of the peaks has the same distance from the upper free rim as the distance of the end of the central tubular body from the upper free rim as measured longitudinally along a central axis of the central tubular body, wherein the peaks and valleys comprise a C/A ratio from 1.5 to 2.5, with C being the distance along the central axis separating the top of the peak from the upper free rim and with A being the distance along the central axis between the top of the peak and the bottom of the valley.

2. The cap of claim 1, wherein the annular wall externally surrounds the central tubular body and wherein said central tubular body comprises a threading for screwing to the container or to the spout.

3. The cap of claim 1, wherein the seal is radially contained within the lower free rim.

4. The cap of claim 1, wherein the annular wall is cap-shaped.

5. The cap of claim 1, wherein valleys and peaks are rounded.

6. The cap of claim 1, wherein said cap comprises a ratio LIP from 6 to 12, wherein P is the distance between the top of a peak and the bottom of an adjacent valley and wherein L is the total circumferential length of the lower rim.

7. The cap of claim 1, wherein the annular wall comprises an aperture next to the base and is joined to the central tubular body by a plurality of angularly distanced tabs, projecting radially outwards from the central tubular body, which join the central body to the annular wall.

8. The cap of claim 1, formed as a single piece comprising plastic material.

* * * * *